US005940884A

United States Patent [19]

Grilliot et al.

[11] Patent Number: 5,940,884

[45] Date of Patent: Aug. 24, 1999

[54] GARMENT, SUCH AS TURNOUT COAT OR COVERALL FOR FIREFIGHTER, WITH COMBINED RAGLAN-DOLMAN PATTERN

[75] Inventors: William L. Grilliot; Mary J. Grilliot, both of Dayton; Patricia Lewis, Huber Heights, all of Ohio; Karl Senser, Camano Island, Wash.

[73] Assignee: Norcross Safety Products, L.L.C., Oak Brook, Ill.

[21] Appl. No.: 09/013,382

[22] Filed: Jan. 26, 1998

[51] Int. Cl.[6] ..... A41B 1/08

[52] U.S. Cl. ..... 2/125; 2/81; 2/93

[58] Field of Search ..... 2/81, 85, 93, 96, 2/98, 106, 108, 113, 114, 115, 116, 122, 125, 127, 128, 243.1, 458

[56] References Cited

U.S. PATENT DOCUMENTS 660,985 10/1900 Dodshon .
3,013,276 12/1961 Maxwell ..... 2/115
5,083,315 1/1992 Dillon, Jr. ..... 2/51
5,165,110 11/1992 Grilliot et al. ..... 2/93
5,410,759 5/1995 Hari ..... 2/108

*Primary Examiner*—Diana L. Oleksa
*Attorney, Agent, or Firm*—Rockey, Milnamow & Katz, Ltd.

[57] ABSTRACT

A garment, such as a turnout coat for a firefighter, comprises a body, which has a front portion and a back portion, a left sleeve, a right sleeve, and a collar. Each sleeve is sewn in a raglan pattern to an associated gusset, which is sewn to a lower part of front portion of the body, at the front portion of the body, and is sewn in a dolman pattern to the back portion of the body. The collar is sewn to the left and right sleeves and to the front portion of the body. The garment is openable and closeable at the collar and at the gussets.

13 Claims, 2 Drawing Sheets

FIG. 1
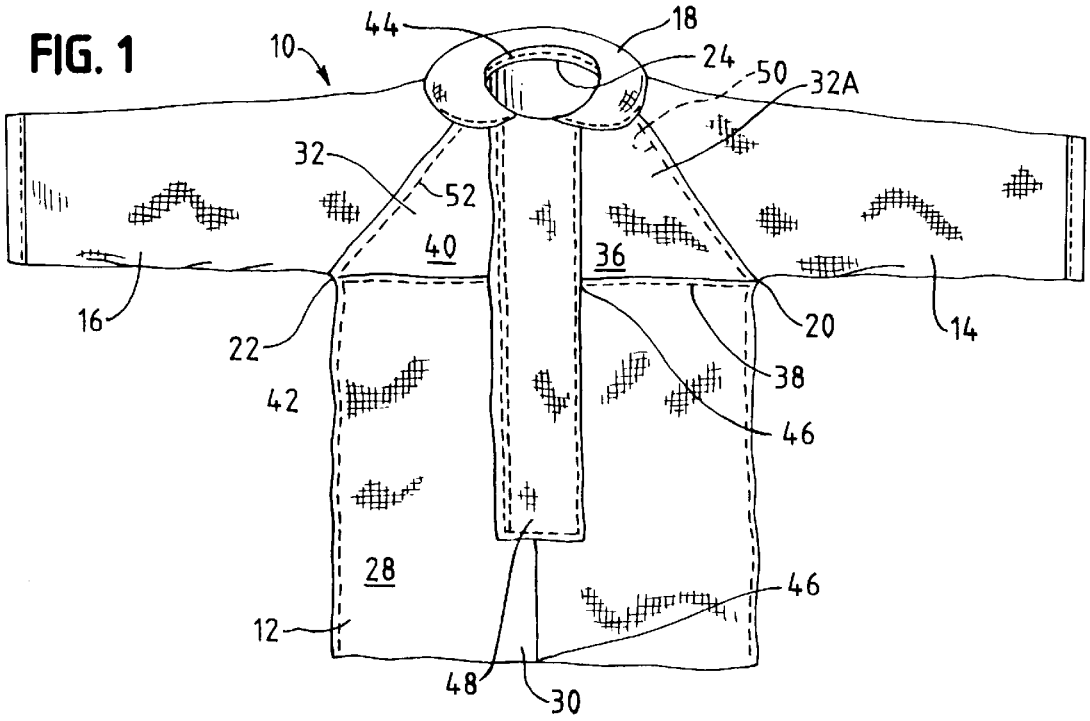
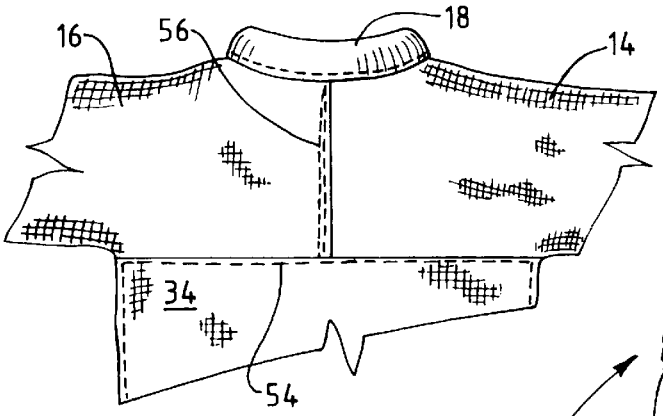
FIG. 2
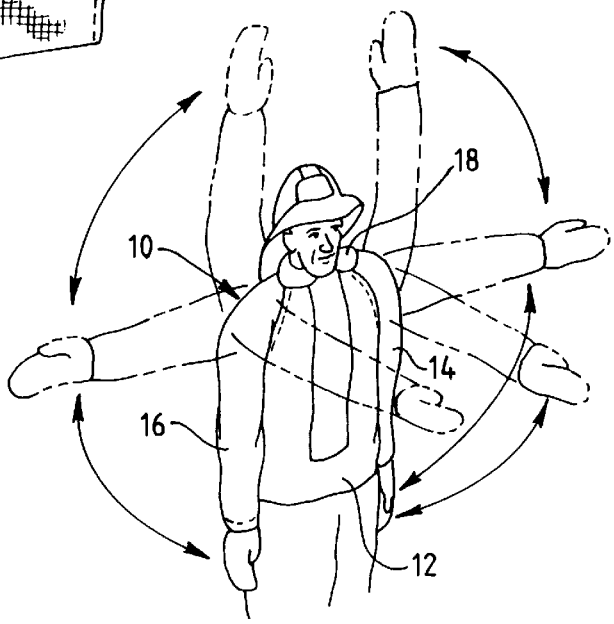
FIG. 3

GARMENT, SUCH AS TURNOUT COAT OR COVERALL FOR FIREFIGHTER, WITH COMBINED RAGLAN-DOLMAN PATTERN

TECHNICAL FIELD OF THE INVENTION

This invention pertains to a garment, such as a turnout coat for a firefighter or a coverall for a firefighter, which comprises two sleeves and a body and which may comprise a collar. This invention contemplates that each sleeve is sewn or attached otherwise in a raglan pattern to a front portion of the body and in a dolman pattern to a back portion of the body.

BACKGROUND OF THE INVENTION

Various patterns are known for sewing the sleeves of a garment, such as a turnout coat for a fireman or a coverall for a firefighter, to the body of the garment. One common pattern is a set-in/box pattern, in which the sleeves are sewn to the body along generally vertical seams, at the front and back portions of the body. Another common pattern is a raglan pattern, in which the sleeves are sewn to the body along slanted seams extending from the underarms to the neckline. Another common pattern is a dolman pattern, in which the sleeves are sewn to the body along a generally horizontal seam extending along the front and back portions of the body and in which the sleeves are sewn to each other along a generally vertical seam, at the center of the back portion of the body.

Each aforenoted pattern has its advantages and its disadvantages. As compared to the raglan and dolman patterns, the set-in/box pattern tends to be most comfortable but tends to use the most material. As compared to the set-in/box pattern, the raglan pattern tends to use less material but tends to place the weight of the garment on the neck, rather than on the shoulders, so as to be less comfortable. As compared to the set-in/box pattern, the dolman pattern tends to use less material but tends to be undesirably bulky, in the front of the garment, when the wearer reaches forward.

SUMMARY OF THE INVENTION

This invention provides improvements in a garment, such as a turnout coat for a firefighter or a coverall for a firefighter, which comprises a body having a front portion and a back portion, a left sleeve, and a right sleeve. Preferably, the coat comprises a collar attached to the left and right sleeves, and the coat is openable and closeable at the collar and at the front portion of the body. This invention contemplates that each sleeve is attached in a raglan pattern to a front portion of the body and in a dolman pattern to a back portion of the body. Herein, all references to attaching refer to sewing, which is preferred, or to gluing or welding, either of which may be alternatively employed in certain applications. Although this invention resulted from efforts to improve a firefighter's garment, such as a turnout coat or a coverall, this invention may prove to be widely applicable to other garments of diverse types.

In a preferred embodiment, the front portion of the body has a lower part and an upper part. Moreover, the upper part comprises a left gusset, to which the left sleeve is attached and which is attached to the lower part of body, at the front portion of the body, and a right gusset, to which the left sleeve is attached and which is attached to the lower part of the body, at the front portion of the body. The coat is openable and closeable at the gussets.

In other words, the body defines a left underarm, a right underarm, and a neckline, the left sleeve is attached to the front portion of the body, along a slanted seam extending from the left underarm to the neckline, and the right sleeve is attached to the front portion of the body, along a slanted seam extending from the right underarm to the neckline. Moreover, each sleeve is attached to the back portion along a generally horizontal seam and the sleeves are attached to each other along a generally vertical seam, at the back portion of the body.

In the preferred embodiment, in which the coat is openable and closeable at the gussets, the left sleeve is attached to the left gusset, along the slanted seam extending from the left underarm to the neckline, and the left sleeve is attached to the lower part of body, at the front portion of the body. Moreover, the right sleeve is attached to the right gusset, along the slanted seam extending from the right underarm to the neckline, and the right sleeve is attached to the lower part of the body, at the front portion of the body.

These and other objects, features, and advantages of this invention are evident from the following description of a preferred embodiment of this invention, with reference to the accompanying drawings.

BRIEF DESCRIPTION OF THE DRAWINGS

FIG. 1 is a front elevation of a turnout coat for a firefighter, which constitutes a preferred embodiment of this invention.

FIG. 2 is a fragmentary, back elevation of the turnout coat, as shown in FIG. 1.

FIG. 3, on a smaller scale, is a fragmentary view showing, in full and broken lines, possible ranges of arm motions of a firefighter wearing the turnout coat, as shown in FIGS. 1 and 2.

Figure 4A:
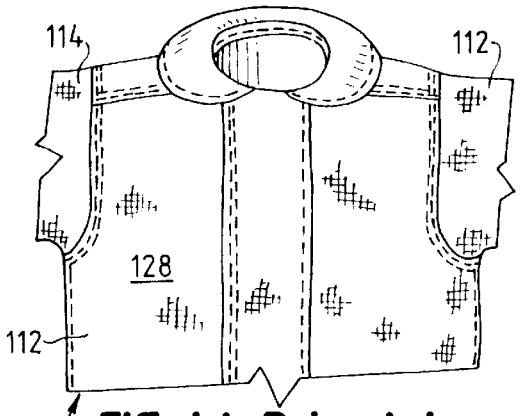
FIG. 4A Prior Art
FIGS. 4A and 4B, respectively, are fragmentary front and back elevations of a turnout coat exemplifying prior art and having its sleeves sewn in a set-in/box pattern to the front and back portions of the body.

Herein, directional terms, such as "left", "right", "front", and "back", are taken from the standpoint of a wearer of a garment, such as a turnout coat for a firefighter.

DETAILED DESCRIPTION OF THE PREFERRED EMBODIMENT

As shown in FIGS. 1 and 2, a turnout coat 10 for a firefighter constitutes a preferred embodiment of this invention. Broadly, the coat 10 comprises a body 12, a left sleeve 14, a right sleeve 16, and a collar 18, all made from cloth materials suitable for sewing. This invention contemplates that each sleeve 14, 16, is sewn in a raglan pattern to a front portion of the body 12 and in a dolman pattern to a back portion of the body 12.

The body 12 defines a left underarm 20, a right underarm 22, and a neckline 24. The body 12 has a front portion 28, which has a lower part 30 and an upper part 32, 32A, and a back portion 34. The upper part 32, 32A, comprises a left gusset 36, which is sewn to the lower part 30 along a generally horizontal seam 38 extending from the left underarm 20 to the neckline 24, and a right gusset 40, which is sewn to the lower part 30 along a generally horizontal seam 42 extending from the right underarm 22 to the neckline 24. The collar 18 is sewn to the sleeves 14, 16, and to the gussets 36, 40, along a seam 44, which follows the neckline 24.

The coat 10 is openable and closeable at the collar 18 and at the front portion 28 of the body 12, along the gussets 36, 40, and along a major portion 46 of the lower part 30 of the body 12. The coat 10 comprises a zipper, buttons, snap fasteners, or other fastening means (not shown) therealong, along with a flap 48 sewn therealong for covering such fastening means while allowing access to such fastening means. Details of such fastening means and of the flap 48 are outside the scope of this invention.

In a raglan pattern, the left sleeve 14 is sewn to the left gusset 36 of the front portion 28 of the body 12, along a slanted seam 50 extending from the left underarm 20 to the neckline 24, and the right sleeve 16 is sewn to the right gusset 40, in a raglan pattern, along a slanted seam 52 extending from the right underarm 22 to the neckline 24. In a dolman pattern, each sleeve 14, 16, is sewn to the back portion 34 of the body 12, along a generally horizontal seam 54, and the sleeves 14, 16, are sewn to each other along a generally vertical seam 56, at the center of the back portion 34 of the body 12.

Figure 4B:
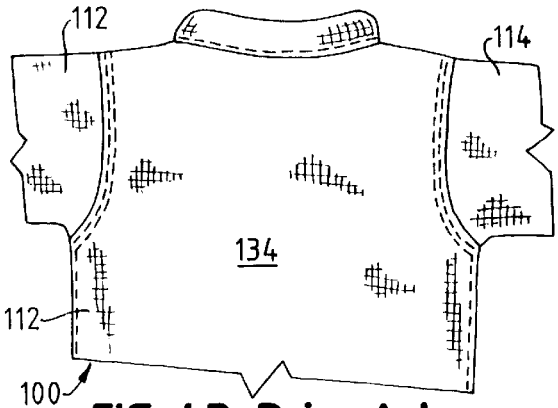
FIG. 4B Prior Art

FIGS. 4A and 4B shown a turnout coat 100 exemplifying prior art and having its sleeves 112, 114, sewn in a set-in/box pattern to the front portion 128 of its body 112 and in a set-in/box pattern to the back portion 134 of its body 112.

Figure 5A:
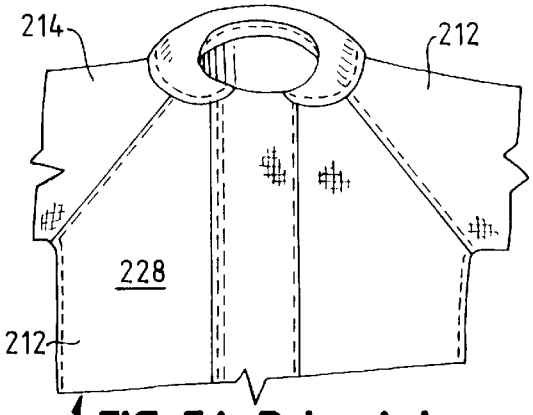
FIG. 5A Prior Art
FIGS. 5A and 5B, respectively, are fragmentary front and back elevations of a turnout coat exemplifying prior art and having its sleeves sewn in a raglan pattern to the front and back portions of the body.
Figure 5B:
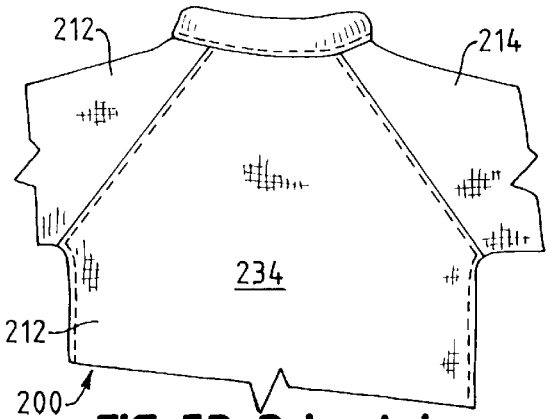
FIG. 5B Prior Art

FIGS. 5A and 5B shown a turnout coat 200 exemplifying prior art and having its sleeves 212, 214, sewn in a raglan pattern to the front portion 228 of its body 212 and in a raglan pattern to the back portion 234 of its body 212.

Figure 6A:
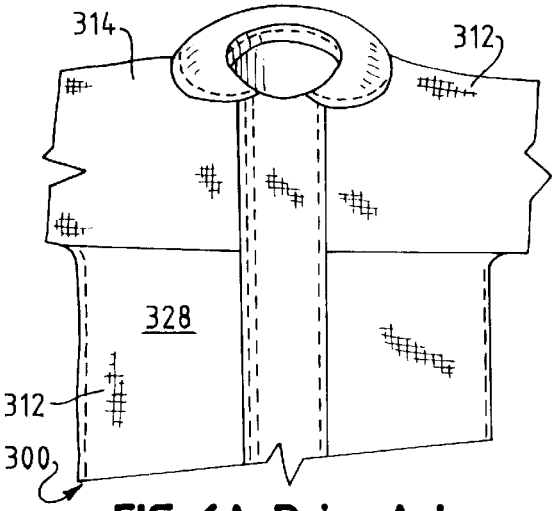
FIG. 6A Prior Art
FIGS. 6A and 6B, respectively, are fragmentary front and back elevations of a turnout coat exemplifying prior art and having its sleeves sewn in a dolman pattern to the front and back portions of the body.
Figure 6B:
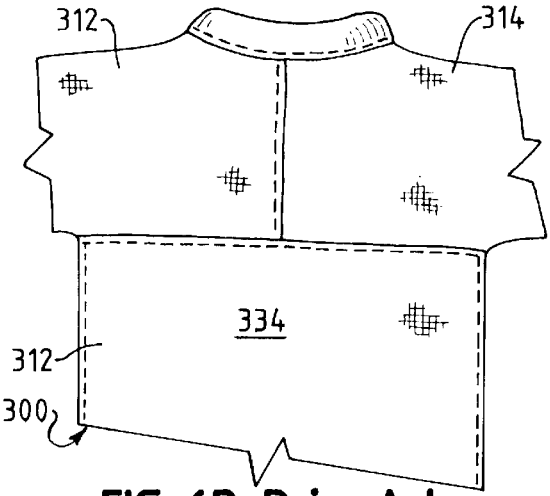
FIG. 6B Prior Art

FIGS. 6A and 6B shown a turnout coat 300 exemplifying prior art and having its sleeves 312, 314, sewn in a dolman pattern to the front portion 328 of its body 312 and in a dolman pattern to the back portion 334 of its body 312.

As compared to the turnout coats 100, 200, 300, the turnout coat 10 provides significant advantages. The coat 10 is economical in its material usage. The coat 10 tends to distribute its weight across the shoulders of a wearer. The coat 10 does not tend to be undesirably bulky, in the front of the coat 10, when the wearer reaches forward.

Where sewing is described above with reference to the turnout coat 10, gluing or welding may be alternatively employed, if the turnout coat 10 is made from a material or materials suitable for gluing or welding.

Various other modifications may be made in the preferred embodiment described above without departing from the scope and spirit of this invention.

We claim:

1. A garment comprising a body, a left sleeve, and a right sleeve, the body having a front portion and a back portion, each sleeve being attached in a raglan pattern to the front portion of the body and each sleeve being attached in a dolman pattern to the back portion of the body.

2. The garment of claim 1 comprising a collar attached to the left and right sleeves.

3. The garment of claim 2 wherein the coat is openable and closeable at the collar and at the front portion of the body.

4. The garment of claim 3 wherein the front portion of the body has a lower part and an upper part, wherein the upper part comprises a left gusset, to which the left sleeve is attached and which is attached to the lower part of body, at the front portion of the body, and a right gusset, to which the left sleeve is attached and which is attached to the lower part of the body, at the front portion of the body, and wherein the coat is openable and closeable at the gussets.

5. The garment of claim 4 wherein the collar is attached to the left and right gussets.

6. The garment of claim 3 wherein the collar is attached to the front portion of the body.

7. The garment of claim 2 wherein the collar is attached to the front portion of the body.

8. A garment comprising a body, a left sleeve, and a right sleeve, the body having a front portion and a back portion and defining a left underarm, a right underarm, and a neckline, the left sleeve being attached to the front portion of the body, along a slanted seam extending from the left underarm to the neckline, the right sleeve being attached to the front portion of the body, along a slanted seam extending from the right underarm to the neckline, each sleeve being attached to the back portion along a generally horizontal seam, the sleeves being attached to each other along a generally vertical seam, at the back portion of the body.

9. The garment of claim 8 comprising a collar attached to the left and right sleeves.

10. The garment of claim 9 wherein the coat is openable and closeable at the collar and at the front portion of the body.

11. The garment of claim 10 wherein the front portion of the body has a lower part and an upper part, wherein the upper part comprises a left gusset, to which the left sleeve is attached, along the slanted seam extending from the left underarm to the neckline, and which is attached to the lower part of body, at the front portion of the body, and a right gusset, to which the left sleeve is attached, along the slanted seam extending from the right underarm to the neckline, and which is attached to the lower part of the body, at the front portion of the body, and wherein the coat is openable and closeable at the gussets.

12. The garment of claim 11 wherein the collar is attached to the left and right gussets.

13. The garment of any preceding claim being a firefighter's garment.

* * * * *